US005320645A

United States Patent [19]

Logue et al.

[11] Patent Number: 5,320,645

[45] Date of Patent: Jun. 14, 1994

[54] PROCESS FOR IMPARTING WRINKLE RESISTANCE AND DURABLE PRESS FINISH TO A FIBROUS GARMENT

[76] Inventors: Bobby T. Logue, 5220 Meadow Lake Rd., Brentwood, Tenn. 37027; David M. Hall, 855 Terrace Acres, Auburn, Ala. 36830

[21] Appl. No.: 4,171

[22] Filed: Jan. 13, 1993

Related U.S. Application Data

[63] Continuation-in-part of Ser. No. 552,236, Jul. 12, 1990, abandoned.

[51] Int. Cl.[5] ..... D06M 23/10

[52] U.S. Cl. ..... 8/116.1; 8/120

[58] Field of Search ..... 8/116.1, 120

[56] References Cited

U.S. PATENT DOCUMENTS

| | | | |
|---|---|---|---|
| 3,526,048 | 9/1970 | Rowland et al. | 8/120 |
| 3,575,960 | 4/1971 | Tesoro | 8/120 |
| 4,820,307 | 4/1989 | Welch et al. | 8/120 |
| 4,904,273 | 2/1990 | Lauchenauer | 8/101 |

FOREIGN PATENT DOCUMENTS 855547 4/1956 United Kingdom .

OTHER PUBLICATIONS

Reeves, W. A. et al. Cotton Cross-Linked at Various Degrees of Fiber Swelling, Textile Research Journal pp. 179-192, Mar. 1960.

*Primary Examiner*—John Niebling
*Assistant Examiner*—Edna Wong
*Attorney, Agent, or Firm*—John Lezdey

[57] ABSTRACT

A process is disclosed for imparting wrinkle-resistance and durable press properties to a fibrous garment which is, desirably, made at least in part of a cellulose fiber. The process involves wetting the fiber or garment such that natural fibers swell or the garment has at least about 30 percent by weight of water. The wetted garment, having the swollen fibers, is then treated with a resin solution. The resin must be suitable for imparting wrinkle-resistance and durable press properties to the fibrous garment. Such resins are known in the art. The resin "treating" solution desirably comprises at least about 10 percent excess of a stoichiometric amount of the resin. The excess solution is removed and the fabric or garment is then dried. The invention can include a step for recycling the excess solution from the treating procedure.

25 Claims, 5 Drawing Sheets

PROCESS FOR IMPARTING WRINKLE RESISTANCE AND DURABLE PRESS FINISH TO A FIBROUS GARMENT

This is a continuation-in-part of application Ser. No. 07/552,236, filed Jul. 12, 1990, now abandoned.

BACKGROUND OF THE INVENTION

1. Field of the Invention

The invention relates to a process for imparting wrinkle resistance and durable press finishes to a fibrous textile or garment. More specifically, the invention relates to a "wet-on-wet" process for imparting wrinkle resistance and durable press finishes to a fibrous textile or garment without predrying the textile or garment.

2. Description of the Background Art

The industry has been applying finishes to both synthetic and natural fibers, that are used to manufacture garments, for many years. Finishes can provide fibers with crease-resistance, wrinkle-resistance, or a durable-press finish. The durable-press finish is often called a "permanent press" or "wash-and-wear" finish. These finishes are, typically, provided by various resin materials and can both desirably or undesirably alter the final characteristics of the finished textile. Crease-resistant finishes are used on cotton, rayon, and linen to prevent wrinkling. Resin finishes are applied to these textiles with processes that involve saturating the textile with the resin and then curing the resin at a temperature of about 360° F. (182° C.). Crease-resistant finishes typically cause the textile to become more stiff, less absorbent, and more resistant to wrinkling. The strength and abrasion resistance of the textile is sometimes lowered, especially when the textile contains cellulose fibers. The extent of the durability of the finish depends upon the percentage of the resin retained in the textile.

A wrinkle-resistant finish is applied to a textile in order to make the textile resistant to wrinkling and to assist the textile in a rapid recovery from wrinkling after it is worn. The effectiveness of the wrinkle-resistance finish depends upon the fiber content of the fabric, the construction of the fabric, and the particular chemical formulation that is applied as the finish. As such, wrinkle-resistant finishes are often combined with water-repellent finishes which can also resist stains. Wrinkle-resistant finishes are easily ironed, but can cause a garment to fail to "take a press" by making the seams, collars, cuffs and hemlines appear wrinkled instead of pressed. Additionally, wrinkle-resistant finishes can cause a loss of strength to the textile.

Durable-press finishes provide textiles or wearing apparel with properties that resist wrinkles and retain creases and pleats throughout many wearings and cleaning treatments. Durable-press processes, typically, heat-set a thermoplastic fiber or apply a resin treatment to a textile. Either system can impart a "memory" in the treated fabric. This memory allows the fabric or textile to retain the original shape that the fabric or textile had when it was either heat-set or cured.

Early durable-press treatment of cotton fabrics provided only "easy care" or "minimum care" textiles which still required some ironing. Heavy resin treatments that were sufficient to cause complete durable-press treatments of cotton required such a high concentration of resin that the cotton suffered a strength loss. Textiles that are 100 percent cotton fabric and treated to have a durable-press finish are of such a heavy construction that many uses in garments are prohibited. Cotton blends with manmade fibers have to be used in order to provide a lightweight fabric.

A postcured permanent press finish, which is also called a deferred-cured permanent press finish, is applied to a fabric by first impregnating the fabric with a resin and then drying the fabric at a low temperature. The drying process is performed such that little or no curing of the resin occurs during this initial finishing process. The fabric is then cut and formed into an apparel or garment. The garment is then pressed to remove wrinkles and to impart creases and pleats. The garment is then cured in an oven at about 350° F. (162° C.) for 5 to 15 minutes. The temperature and time for this curing process varies depending upon the fabric and garment. This curing process sets the garment in the shape it has upon entering the curing oven. This process is commonly known as a "wet-on-dry" process.

The "wet-on-dry" process requires garments to be dried after an initial laundering. After this drying, the garments are then soaked, typically, in a cold solution of a cross-linking reagent, and then redried. The result is that a cotton fiber does not undergo a significant reswelling such that the cotton lumen or central hole in the cotton fiber becomes open and distinct. In the wet-on-dry process, the cotton lumen actually closes or collapses throughout the majority of the cotton fibers. This collapse of the cotton lumen causes the cotton fiber structure to become more rigid and to have a more "effective" diameter. Examples of these processes in cross-linking reagents are as follows.

The use of polycarboxylic acids with or without catalysts in pad, dry, and cure treatments to impart wrinkle resistance to cotton fabric was studied by Gagliardi and Shippee, *American Dyestuff Reporter* 52, pp. 300–303, (1963). They observed small increases in fabric wrinkle resistance after relatively long periods of heating and noted larger fabric strength losses than are obtained with formaldehyde-based cross-linking agents. These excessive strength losses and the low yield of cross-linkages were attributed to the long heat curing times needed with the inefficient catalysts then available.

A more rapid and effective curing process for introducing ester cross-links into cotton cellulose was described by Rowland et al, *Textile Research Journal* 37, pp. 933–941, (1967). Polycarboxylic acids were partially neutralized with sodium carbonate or triethylamine prior to application to the fabric in a pad, dry, and heat cure type of treatment. Cross-linking of cellulose was obtained whenever the polycarboxylic acid contained three or more carboxyl groups suitably located in each molecule. With certain polycarboxylic acids, a useful level of wrinkle resistance was imparted. The conditioned wrinkle recovery angle was measured before and after five laundering cycles and was found to decrease somewhat as a result of laundering. This occurred even though no loss of ester groups was detected. Neutralization of carboxyl groups with 2 percent sodium carbonate, even at room temperature, caused a 30 percent loss of ester groups. This indicates a lack of durability of the finish of alkaline solutions such as solutions in alkaline laundering detergents. The curing time needed in fabric finishing was, moreover, too long to permit high speed, mill-scale production.

Subsequently, it was shown by Rowland and Brannan, *Textile Research Journal* 38, pp. 634–643, (1968), that cotton fabrics given the above cellulose cross-linking treatment with polycarboxylic acids were recurable. Creases durable to five laundering cycles were imparted to the fabrics by wetting the latter, folding, and applying a heated iron. Evidence was obtained that the ester groups and adjacent free hydroxyl groups on cotton cellulose formed cross-links.

The term "wrinkle resistance" in this art is defined by AATCC Method No. 66-1984, 1988, *Technical Manual*, American Association of Textile Chemists and Colorists, Research Triangle Park, North Carolina. Other standard tests used in the art of finishing fabrics and garments are listed in Table 1.

TABLE 1

| Test Property | Measuring Units | Title of Test |
|---|---|---|
| Break Strength-Warp | pounds of force | ASTM: D1682-64 GRAB |
| Break Strength-Fill | pounds of force | ASTM: D1682-64 GRAB |
| Tear Strength-Warp | pounds of force | ASTM: 1424-83 Elmendorf |
| Tear Strength-Fill | pounds of force | ASTM: 1424-83 Elmendorf |
| Flex Abrasion | cycles | ASTM: D1175-71 Flex |
| Shrinkage-Waist | percentage | AATCC 150-84IIIB 3 cyc. |
| Shrinkage-Inseam | percentage | AATCC 150-84IIIB 3 cyc. |
| Colorfastness-Gray Scale | | |
| Laundering | change of class | AATCC 150-84IIIB 3 cyc. |
| Crocking - Wet | change of class | AATCC 8-81 |
| Crocking - Dry | change of class | AATCC 8-81 |
| Light | FU | AATCC 16E-82 |
| Ozone | change of class | AATCC 109-83 2 cycles |
| Formaldehyde | ppm | AATC 112-84 |
| pH | | AATCC 81-83 |
| Crease Retention | | |

These findings were elaborated by Rowland et al in U.S. Pat. No. 3,526,048. Sodium carbonate or triethylamine was again used as the base to partially neutralize the polycarboxylic acid that was subsequently applied as the cellulose cross-linking agent. Rowland et al, defined their process as requiring neutralization of 1 percent to 50 percent of all carboxylic acid functionality by a "strong base" selected from the group consisting of alkali metal hydroxides, carbonates, bicarbonates, acetates, phosphates, and borates. This neutralization is required prior to impregnating the fibrous cellulose with the aqueous polycarboxylic acid and heating to induce cross-linking. A strong base selected from the group consisting of ammonia and certain amines was also indicated as suitable for the partial neutralization of the polycarboxylic acid.

Stated limitations of the process of Rowland et al are that the process cannot be conducted with acids of fewer than three carboxyl groups per molecule or with acids containing olefinic unsaturation or hydroxyl groups. The reasons provided for these limitations were lack of reaction with cellulose chains for development of high levels of wrinkle resistance.

U.S. Pat. No. 4,820,307, to Welch et al discloses, as cellulose cross-linking agents, polycarboxylic acids which include aliphatic, alicyclic, and aromatic acids. However, the acids are either olefinically saturated or unsaturated with at least three carboxyl groups per molecule or with two carboxyl groups per molecule if a carbon-carbon, double bond is present either alpha or beta to one or both carboxyl groups. An additional requirement which is stated for esterifying cellulose hydroxy groups, is that in an aliphatic or alicyclic acid a given carboxyl group must be separated by no less than two carbon atoms and no more than three. It is further stated that when two carboxyl groups are both connected to the same ring, the two carboxyl groups must be in the cis configuration in order to react and form anhydrides which can esterify with cellulosic hydroxyl groups.

U.S Pat. No. 3,203,886, to Griffin discloses a photodimerization process for preparing trans polycarboxylic acids. These compounds can be used as cross-linking agents to impart wrinkle resistance to cellulosic textiles.

Other tests for evaluating textile and garment finishes are also known in the art.

It is an object of the present invention to provide a method for imparting wrinkle-resistance and durable press finishes to a fibrous garment by a wet-on-wet process.

It is another object of the present invention to provide a simplified wet processing procedure to eliminate the necessity of an interim drying step prior to application of finishing reagents.

It is another object of the present invention to provide a process for finishing completed garments in the wet state.

Other objects, advantages, and novel features of the present invention will be apparent to those skilled in the art from the following description and appended claims.

SUMMARY OF THE INVENTION

The objectives of the present invention are achieved by a process for imparting wrinkled-resistance and durable press finishes to a fibrous textile or garment. This process comprises the following steps. Wetting of the garment is performed to obtain an added moisture content of 30 percent by weight of water so as to swell any natural fibers in the textile or garment. Treating of the wetted textile or garment then occurs with a solution of a resin capable of imparting wrinkle-resistance and durable press properties to the textile or garment. The treating solution comprises at least about a 10 percent excess of a stoichiometric amount of the resin. Removing of the excess solution and drying of the textile or garment then occurs.

Desirable embodiments of the process include a step for recycling the excess solution from the treating procedure.

DESCRIPTION OF THE PREFERRED EMBODIMENT

Figure 1:
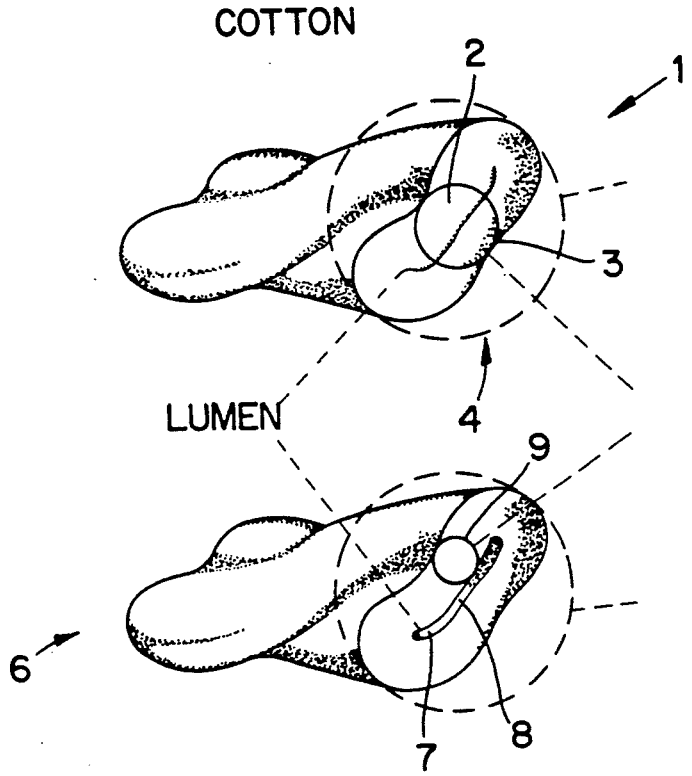
FIG. 1 illustrates a perspective view of cross-sections of the lumen of two cotton fibers.

The invention is a process for imparting wrinkle-resistance and durable press properties to a fibrous textile of garment which is, desirably, made at least in part of a cellulose fiber. The process involves wetting the fiber of the textile or garment such that the fibers swell or the garment comprises at least about 30 percent by weight of water. The wetted textile or garment, having the swollen fibers, is then treated with a resin solution. The resin must be suitable for imparting wrinkle-resistance and durable press properties to the fibrous textile or garment. Such resins are known in the art. The resin "treating" solution desirably comprises at least about 10 percent excess of a stoichiometric amount of the resin. The excess solution is removed and the fabric or garment is then dried.

The term "textile" refers to a cloth or fabric before it has been cut and assembled into a "garment" or other item. The process of this invention can be used with a textile, a garment, to other fibrous material. The process is most useful with manufactured garments. For this reason the term "garment" is used in the description of the invention, but is not intended to limit the use of the invention only to garments.

This process has a desirable effect of allowing the resin to enter the lumen of the fiber such that cross-linking can occur. The unexpected result of this effect is that the treated fiber dries with an open lumen. This result provides a fabric having wrinkle-resistance and durable press properties as well as a soft, flexible hand-feel and good strength.

It is understood that the term "open lumen" used herein in reference to a garment means that a majority of the fibers in the garment have an open lumen. This is in contrast to the wet-on-dry process wherein a majority of the fibers in the garment have a closed lumen. It is further understood that closed lumens may be present in the garment because the yarn blends may contain immature fibers.

The "Wetting" procedure of this invention provides sufficient moisture to a garment or textile to distend or swell the fiber of the garment. The fibers of a garment are sufficiently moistened when the wetted fibers, which are desirably cellulosic fibers, contain at least about 30 percent by weight water. The moisture content of a particular fiber in a garment is a function of soaking time, water temperature, and the weave of the fiber. The moisture content of a soaked fiber can be predicted from moisture retention data.

Moisture retention data is obtained by weighing a plurality of individual garments from a sample of garments. The individual garments are soaked for a period of time and then undergo extraction to remove excess water. The period during which the garments are soaked is increased and additional extractions are conducted. The weight of the individual garments is determined after each of the soaking and extraction periods. The weight of the individual garments in this sample is then averaged and moisture content percentages are determined. A "bone dry" weight of the fabric is also obtained by cutting a sample from one of the garments, weighing that sample, heating that sample in an oven at about 105° C. for two hours, and then again weighing that sample. The weight of the sample after oven drying is compared to the original weight of the sample in order to obtain a "ambient water content" of the fabric.

An example of moisture retention data is provided for a specific garment, such as 100 percent cotton trousers, by performing the above-described process on a sample of 50 pairs of the cotton trousers. The trousers are soaked at ambient temperature and weighed after being extracted for time periods of one, two, three, four, and five minutes. A "bone dry" weight is also calculated for each pair of trousers. The moisture content is then calculated for each pair of trouser for these time periods. An average moisture content is then calculated from the data of the 50 samples of trousers. An example of averaged data for 50 samples of cotton trousers is presented in Table 2 as follows.

TABLE 2

| | 1 minute moisture content % | 2 minute moisture content % | 3 minute moisture content % | 4 minute moisture content % | 5 minute moisture content % |
|---|---|---|---|---|---|
| Average | 38.95 | 38.03 | 36.80 | 35.75 | 35.39 |
| Median | 38.78 | 37.96 | 36.54 | 36.00 | 34.95 |
| Range | | | | | |
| (high) | 43.88 | 42.73 | 41.28 | 41.18 | 43.14 |
| (low) | 33.98 | 32.99 | 32.04 | 31.19 | 31.73 |
| Width of Range | 9.90 | 9.74 | 9.24 | 9.99 | 11.41 |
| Standard Deviation | 2.24 | 2.27 | 2.38 | 2.32 | 2.51 |

The cumulative results of numerous studies of moisture retention data for various garments concludes that a garment can be considered "wet" when its moisture content is in excess or at least about thirty (30) percent of the weight of the dry garment. Garments, particularly those containing cellulosic fibers, become "wet" in approximately 10 to 20 minutes when soaked in water. Typically, a garment has maximum saturation or in "wet" in about 12 minutes when soaked in water that has temperature from about ambient to about 120° F. (about 21° C. to about 50° C.). A water temperature of about 95° F. (35° C.) provides a desirable "cold" water soak that saturates 100 percent cotton trousers in 12 minutes in eight steps. The eight steps are performed in a commercially available laundering device sold under the trade name Braun Washnet. The eight steps include the cycles of wash at 120° F. (50° C.), drain, rinse at 120° F. (50° C.), drain, rinse at 120° F. (50° C.), extract, shakeout, and "end" or break. The laundering device is operated at 20 rpm during the wash, shakeout, rinse, and break cycles.

The "treating procedure of this invention exposes the wet garments to a resin solution. The resin solution must be suitable for imparting wrinkle-resistance and durable press properties to the fibrous garments. Treating garments with these commercially available resins requires an adequate period of exposure of the wet garments to a solution of the resin. The resin solutions are typically aqueous based and added to the wet garments at ambient temperature. Elevated temperatures for the resin solutions up to about 120° F. (50° C.) can enhance the action of the resin treatment, but add to the overall energy requirement of the procedure. Delayed cure resins for imparting wrinkle resistance and durable press properties to textiles are known in the art and are particularly desirable for use with the invention.

The wet-on-wet chemical or resin solution used in this process can be prepared in the same manner as that used for the wet-on-dry process which is known in the art. The wet-on-wet chemical solutions are prepared in this known manner except that an allowance is made for the moisture content of the extracted garment. The wet-on-wet chemical solution which is added to the processing apparatus must be of a greater concentration than the solutions added to dry fabrics. The greater concentration is necessary because of the moisture content already contained by the fabric. The determination required to quantify the allowance which must be made for the moisture content of extracted garments is provided by moisture retention data. The objective of this adjustment in concentration or over saturation is to expose the fiber of the wet garment to at least a 10 percent excess of the stoichiometric amount of resin required to treat the fiber of the same garment when the garment is dry. This excess concentration increases the rate of the treatment of garment and the uniformity of the treatment of the garment with the resin. A 50 percent excess of the stoichiometric amount of a durable press resin in solution is desirable for use with this invention and a 100 percent excess of the stoichiometric amount is preferred. The exact concentration of resin in solution can be altered according to the characteristics of the particular resin used.

The "removing" procedure of this invention separates excess resin solution from the treated garments. This procedure is performed by commercially available laundering equipment in drain or extraction cycles.

The "drying" procedure of this invention is performed by air drying or, preferably, standard commercial laundry driers. Commercial dryers used heated, forced air while tumbling the garments to remove moisture from the garments. The garments are dried until little or no moisture is apparent to one touching the garment.

It is economically desirable to include a "recycling" procedure for the excess resin solution after the treating procedure of this invention. Recycling the resin solution prevents the waste of the stoichiometric excess of resin used to treat a garment and eliminates an unnecessary release to the environment of the resin as a waste product. The recycled resin solution, subsequent to the treating procedure has no significantly adverse characteristics, such as excess dye or lint, that prohibits replenishment and reuse of the resin solution.

The wet-on-wet durable press treatment process of this invention can be used with same textiles of all natural fibers, natural and synthetic blends cf fibers, and all synthetic fibers that durable press resin solutions are used in wet-on-dry treatment processes. This is because the fibers of the textiles and the durable press resins are the same with either process. This wet-on-wet process of the invention provides at least two notable unexpected results which are economic advantages and improved physical characteristic with textiles containing cellulosic fibers.

The unexpected result of the invention, of being more economically desirable than the wet-on-dry process, occurs because of the energy, equipment, and labor, savings provided by the efficiencies that are inherent with applying the durable press resins to the wetted garments. An example of this economic benefit of the invention is the elimination of an extra rinse cycle and extra dying step that are required with the wet-on-dry process. Assuming that these two steps cost 6 cents per pound of fabric, which represents 5 cents for hot water and drying costs plus 1 cent for the water itself, the savings from eliminating these steps with the wet-on-web process amount to $14.22 per average batch of 237 pounds (108 kilograms) of fabric. Additionally, the recycled resin solution of the wet-on-wet process contains minimal contamination from dye and, therefore, can often be recycled and used with textiles of a different color.

The invention also provides the unexpected result of improved physical characteristics with textiles containing cellulosic fibers. Cellulosic fibers, such as cotton, in their natural, dry state are hollow in that the fibers have a lumen. The lumina of these fibers collapse when they are wetted and dried. Cellulosic fibers have a desirable characteristic of being soft when their lumina are not collapsed. The wet-on-wet process of this invention permits the durable press resin to treat the cellulosic fibers while the lumina are in an open condition. After the wet-on-wet treating procedure, the lumina of the cellulosic fibers remain open and the resulting garment made from these fibers is softer than a comparable garment treated by the same durable press resins, but with a wet-on-dry process.

According to an embodiment of the invention there is provided a process for imparting wrinkle resistance and durable press properties to a fibrous garment containing crosslinkable fibers which has undergone a scouring process. The process comprises the steps of soaking a garment in an aqueous solution so that the fibers of the garment swell and a majority of the fibers have an open lumen. The garment is maintained in a wetted condition and comprises at least about 30 percent by weight of water. The wetted garment is treated with a solution of a crosslinking resin so that the resin imparts wrinkle resistance and durable press properties to the garment while maintaining the open lumen in the majority of the fibers. The solution of the resin is comprised of at least about a 10 percent excess of a stoichiometric amount of the resin required to treat the garment. The process further comprises removing excess resin solution from the garment and drying the garment so that the open lumen of the majority of the fibers is maintained in the fibers of the dry garment.

FIG. 1 illustrates a perspective view of cross-sections of the lumen of each of two cotton fibers. Cotton fiber 6 is a dry fiber after a wet-on-wet durable press treatment according to the invention. Cotton fiber 6 has an open lumen 7. The open lumen 7 provides cotton fiber 6 with an actual fiber diameter 9 that is not altered by the open or closed condition of the lumen 2. The open lumen 7 provides cotton fiber 1 with an effective fiber diameter 9. Cotton fiber 1 is a dry fiber after a wet-on-dry durable press treatment. Cotton fiber 1 has a closed lumen 2. The closed lumen 2 provides cotton fiber 1 with an actual fiber diameter 3 that is not altered by the open or closed condition of the lumen 2. The closed lumen 2 provides cotton fiber 1 with an effective fiber diameter 3. The larger effective fiber diameter of cotton fiber 1, which has a closed lumen 2, causes this fiber to have a stiffer or less flexible physical characteristic than cotton fiber 6, which has a comparatively smaller effective diameter 9.

Figure 2A:
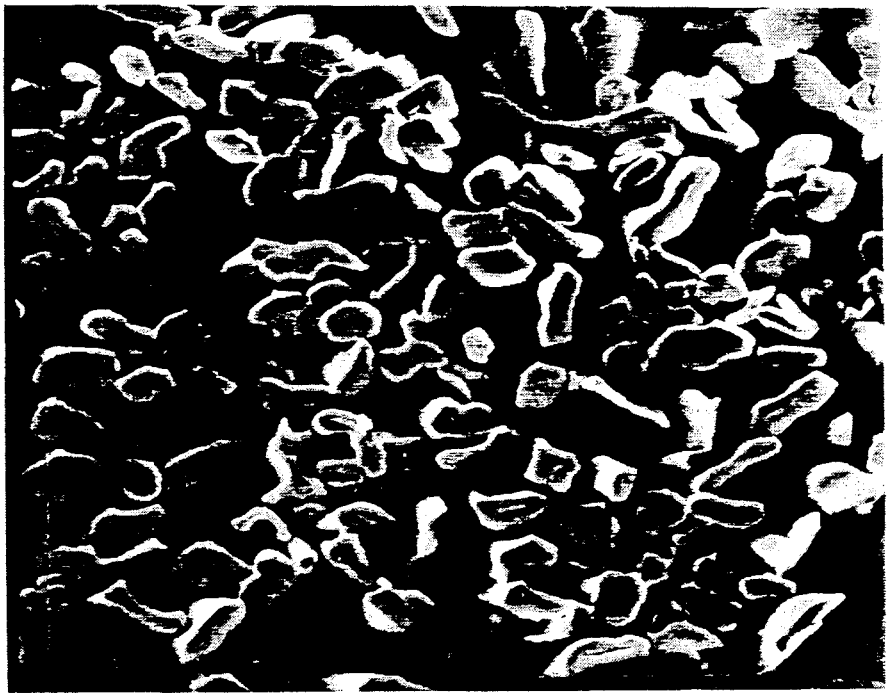
FIG. 2A is a 1,000×photomicrograph of cotton fibers from trousers washed and dried.
Figure 2B:
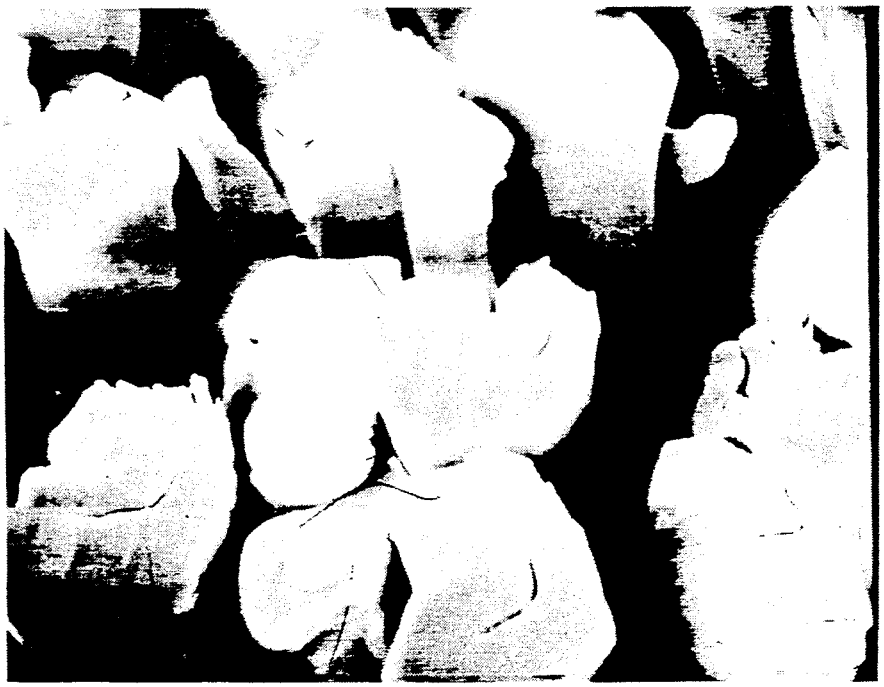
FIG. 2B is a 2,000×photomicrograph of the cotton fibers of FIG. 2A.

FIGS. 2A and 2B are, respectively, a 1,000×and a 2,000×photomicrograph of the same cotton fibers 10 from trousers that have been washed and dried. The lumina 11 of cotton fibers 10 are collapsed, thus, providing the cotton fibers 10 with a stiff hand feel or physical characteristic.

Figure 3A:
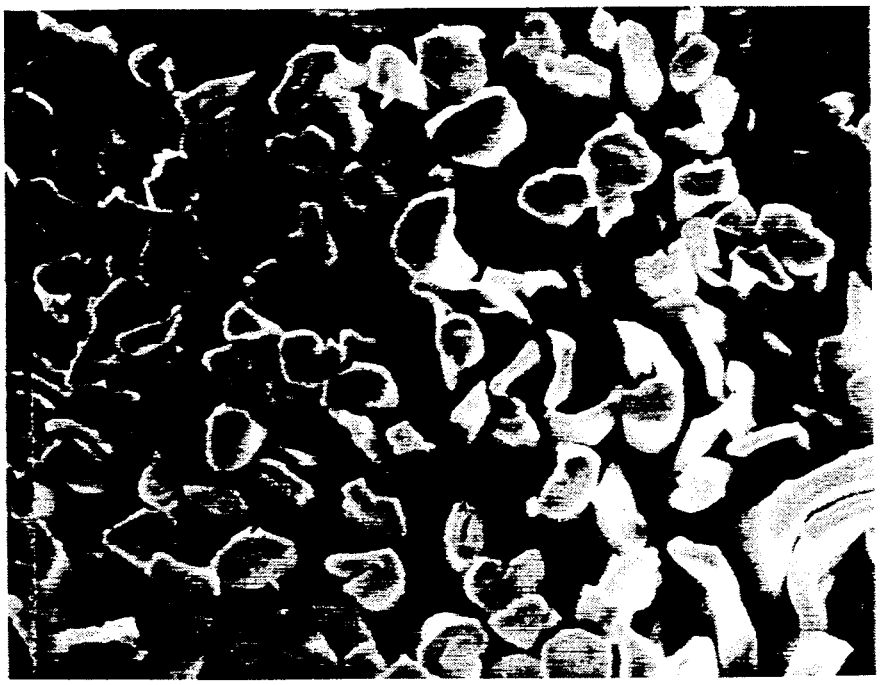
FIG. 3A is a 1,000×photomicrograph of cotton fibers from trousers washed and dried, wetted in cold cross-linking reagent, redried, and cured.
Figure 3B:
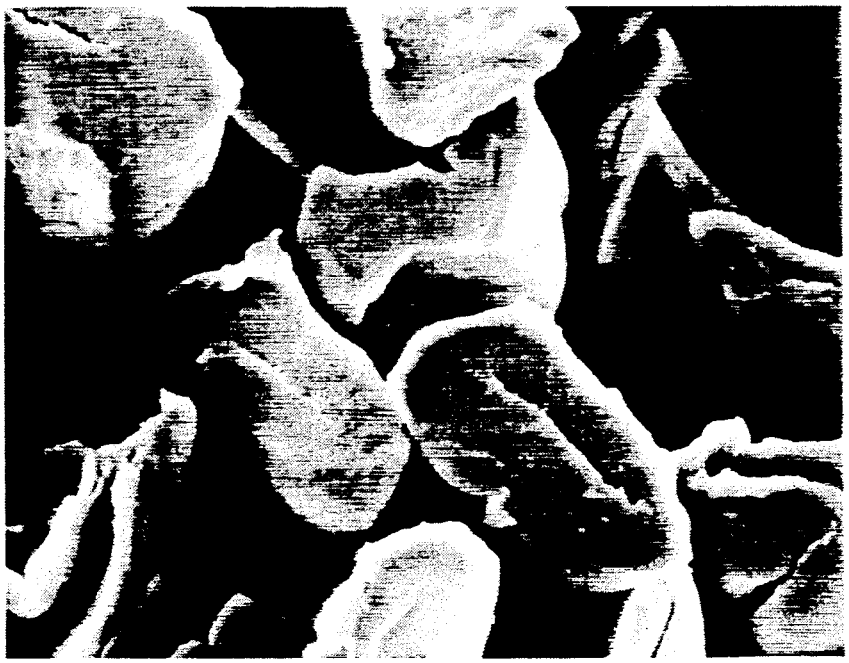
FIG. 3B is a 2,000×photo-micrograph of the cotton fibers of FIG. 3A.
Figure 4A:
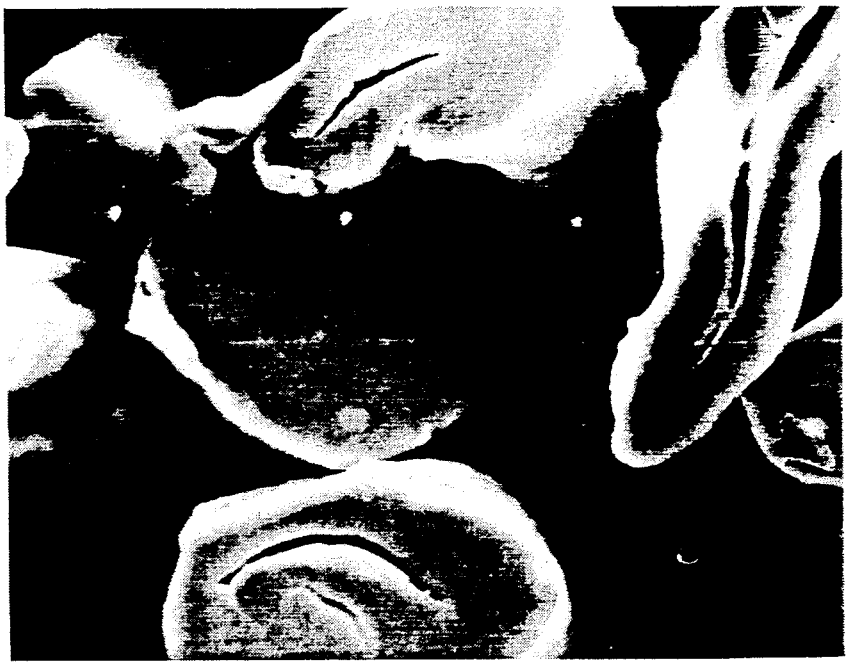
FIG. 4A, 4B, 4C, and 4D are 2,000×photomicrographs of cotton fibers from trousers washed, but never dried, soaked in cross-linking reagent, dried, and cured according to the invention.
Figure 4B:
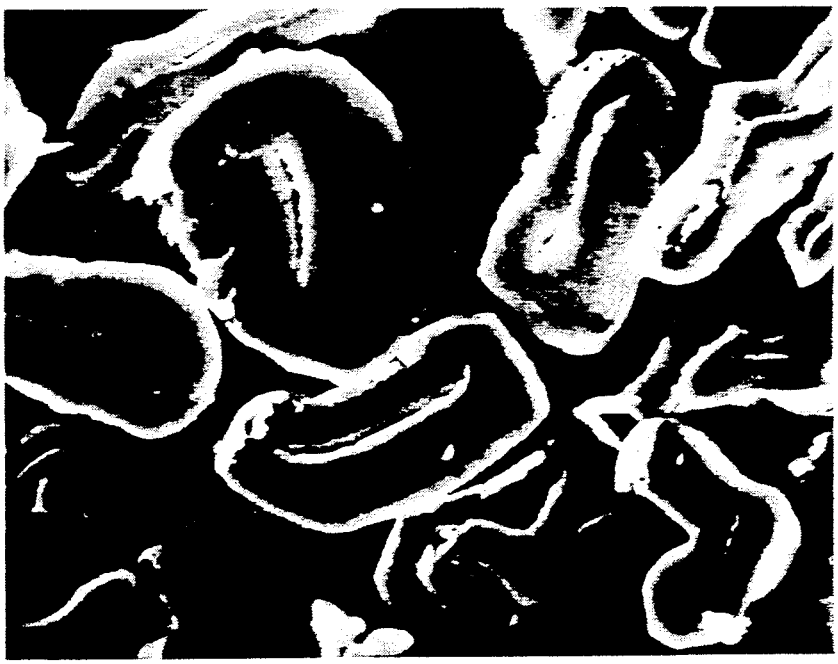
Figure 4C:
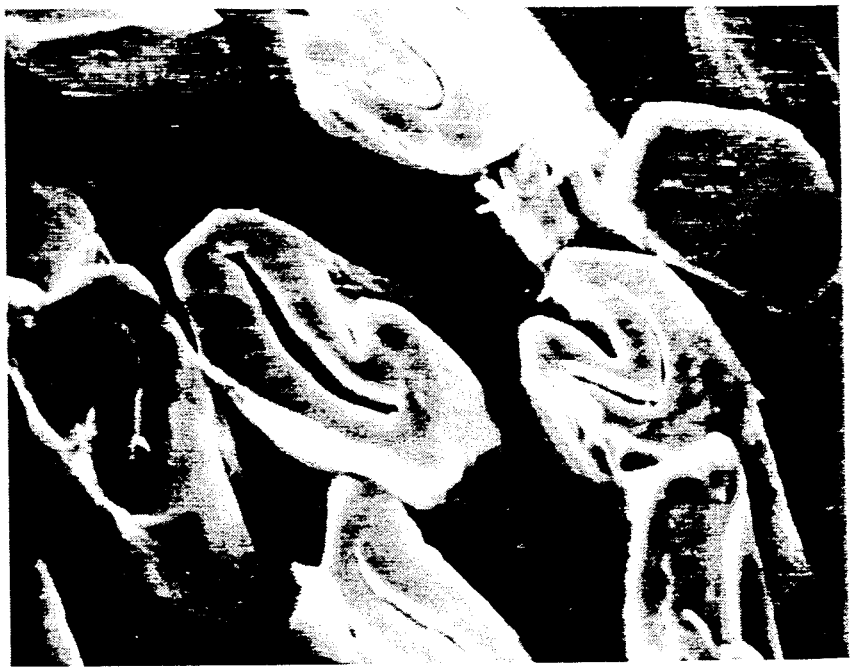
Figure 4D:
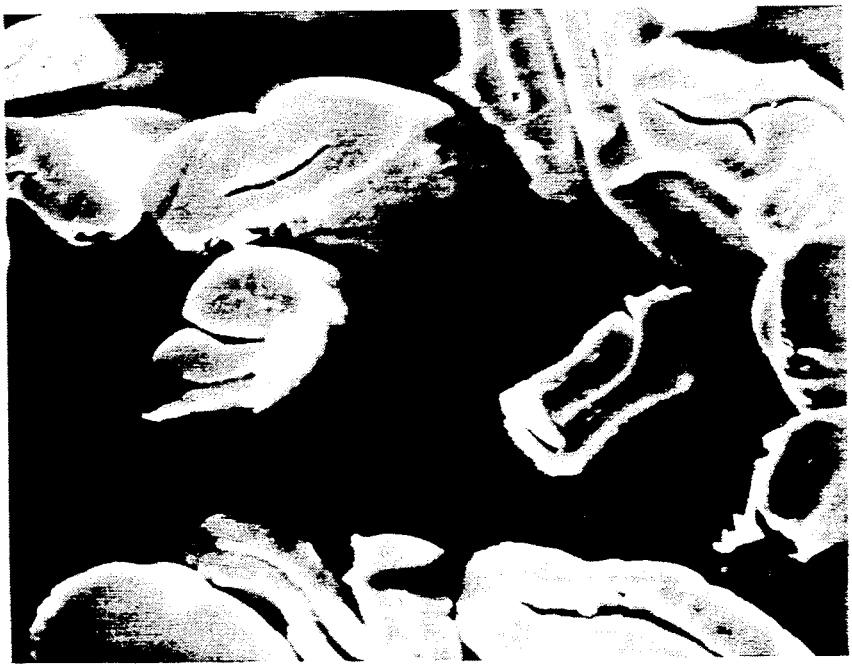

FIGS. 3A and 3B are, respectively, a 1,000×and a 2000×photomicrograph of cotton fibers 15 from trousers that have been washed and dried, wetted in cold cross-linking reagent, redried, and cured. The lumina 16 of these wet-on-dry processed cotton fibers 15 are collapsed and the cotton fibers 15 have a stiff hand feel to one handling or wearing a garment made from these cotton fibers 15.

FIG. 4A, 4B, 4C, and 4D are 2,000×photomicrographs of cotton fibers 20 from trousers that have been washed, but never dried, soaked in cross-linking reagent, dried, and cured according to the invention. The lumina 21 of these wet-on-wet processed cotton fibers 20 are open. The cotton fibers 20 of these figures are softer to the touch than are the cotton fibers 10 of FIGS. 2A and 2B or cotton fibers 15 of FIGS. 3A and 3B.

All percentages in the following examples are by weight. The examples are merely illustrative of the process of the present INVENTION. Changes and modifications in the specifically described embodiments can be performed without departing from the scope of the invention which is intended to be limited only by the scope of the claims.

EXAMPLES

The following examples of the invention are presented with control or comparative examples. The comparative examples do not represent the invention).

The examples and comparative examples were all performed on commercially available, 100 percent cotton, men's trousers. The trousers were initially washed in accordance with the manufacturer's recommended washdown formula. This washdown formula is typical of other formulas used within the industry and includes sequential washing of the cotton trousers with bleach, water, caustic soda, bisulfite, softener, detergent, enzyme stripper, and ohelate. The manufacturer's recommended washdown formula prepares the cotton trousers for further treatment such as durable press treatment.

The equipment and durable press resin solutions used in the examples and comparative examples are commercially available laundering devices. The washer/extractor is sold under the trade name Braun 100 Washnet. The dryer is gas fired with automatic controls and sold under the trade name CLM 400 GP. The durable press resin solution is a commercially available solution from High Point, N.C. The resin solution is comparable to other, commercially available durable press compositions that can be used with the process of this invention and which are described in the background art. The resin solution is applied by placing the garments in the Braun 100 washer/extractor, adding the resin solution, agitating for four minutes, and extracting for three minutes.

EXAMPLES 1 AND 2

Examples 1 and 2 represent the wet-on-wet durable press treatment process of the invention, Example 1 represents the use of the invention with natural fiber garments. Example 2 represents the use of the invention with synthetic fiber garments.

The application of the chemical solution is achieved by manually dipping garments supplied by a commercial trouser producer in a bath contained in a polyethylene vessel or watering trough. Garments are weighed by means of a produce scale graduated in tenth of pounds increments. Batches of six garments are used for this weighing process with totals used to calculate test results.

Softened process water at 61° F. (16° C.) is used to charge the bath with no exothermic reaction being indicated during the solution preparation phase. A slight increase in bath temperature is noted during the test period which results from the ambient room temperature being at 76° F. (25° C.).

Solution additions are made on a weight basis. The bath formula listed below in Table 3 is derived from information supplied by High Point Chemical Company.

TABLE 3

| Composition of bath by weight | | |
|---|---|---|
| Process Grade Water | 500.0 pounds | (227.0 kilograms) |
| High Point Durable Press Finish | 50.0 pounds | (22.7 kilograms)[1] |
| High Point BTU Finish | 15.0 pounds | (6.8 kilograms) |
| High Point EJW Finish | 0.5 pounds | (0.23 kilograms) |
| Initial solution weight: | 565.5 lbs. | |
| Final solution weight: | 71.0 lbs. | |
| Bath temperature: | 61° F. (16° C.) | |
| Bath pH | pH 4 | |
| High Speed Extract | 3 minutes | |

[1]These are not durable press finishes. These finishes add to the desirability of the appearance of the final garment and are commonly used in the treatment of garments.

All garments in Examples 1 and 2 are prewashed according to the manufacturer's instructions before durable press wet-on-wet treatment. Loose dye is, thereby, removed. This pretreatment removal of loose dye provides no observable color change in the durable press treatment solution. The corduroy garments require additional hot rinse cycles to remove loose dye, lint, and sudsing. The results of Example 1 and 2 are presented in Tables 4 and 5 as follows:

TABLE 4

Table 4 presents the results of Example 1 on a variety of 100 percent cotton trousers.

| Sample | No. Batch | Batch Dry Weight | Batch Wet Weight | Batch Extract Weight |
|---|---|---|---|---|
| lt green cotton prewash | 24 | 26.0 lbs | 69.3 lbs | 38.0 lbs |
| lt tan coton prewash | 23 | 21.3 | 51.8 | 29.9 |
| grey pigment lt stonewash | 23 | 29.8 | 59.5 | 41.5 |
| blue pigment lt stonewash | 23 | 21.0 | 82.1 | 43.3 |
| Velcolex blue prewash | 23 | 19.8 | 66.5 | 29.2 |
| corduroy brown POW washout | 23 | 31.0 | 99.9* | 44.3 |
| corduroy brushed prewash | 23 | 27.1 | 85.9 | 50.0 |
| indigo stonewash/bleach | 23 | 36.3 | 96.7 | 55.3 |
| black stonewash | 23 | 24.4 | 73.1 | 42.1 |

*Weight exceeded capacity of scales.

TABLE 5

Table 5 presents the results of Example 2 in a variety of synthetic fiber trousers.

| Sample | No. Batch | Batch Dry Weight | Batch Wet Weight | Batch Extract Weight |
|---|---|---|---|---|
| poly/rayon | 6 | 5.0 | 11.7 | 6.6 |
| poly/rayon | 6 | 6.0 | 12.9 | 6.8 |
| poly/rayon | 6 | 5.8 | 12.8 | 6.8 |
| poly/rayon | 6 | 5.4 | 12.2 | 7.4 |
| blue stripe | 6 | 5.5 | 13.2 | 7.4 |

The moisture extracted trousers of both Examples 1 and 2 are then dried and pressed. The resulting trousers have a durable press finish.

EXAMPLES 3 and 4

COMPARATIVE EXAMPLES A and B

Examples 3 and 4 illustrates the process of the invention in comparison with Comparative Examples A and B. Example 3 uses a wet-on-wet process with a "light application" of durable press resin solution of 10 percent in excess of a stoichiometric amount of the resin. Example 4 uses a wet-on-wet process with a double-concentrated stock solution or a "heavy application" of durable press resin solution of 100 percent in excess of a stoichiometric amount of the resin. Comparative Example A represents cotton trousers that have been subjected to a washdown formula, but which have not been treated with a durable press resin. Comparative Example B uses a wet-on-dry process with a "medium application" of durable press resin solution of 50 percent in excess of a stoichiometric amount of the resin. The results of these examples and comparative examples are presented in Table 6 and 7 as follows:

TABLE 6

| Sample | GRAB[1] Strength, lbs | TEAR[1] lbs | ABRASION[1] cycles |
|---|---|---|---|
| Exp. 3 | W 65.6 | .19 | 2283 |
| | F 35.7 | .18 | 264 |
| Exp. 4 | W 82.0 | .30 | 2007 |
| | F 43.9 | .26 | 479 |
| Comp. Exp. A | W 151.2 | .33 | 821 |
| | F 94.5 | .32 | 654 |
| Comp. Exp. B | W 93.7 | .35 | 3075 |
| | F 65.6 | .30 | 521 |

TABLE 7

| Sample | SHRINKAGE[2] TEST | WRINKLE[3] RECOVERY |
|---|---|---|
| Exp. 3 | No change | 120 283 Total 163 |
| Exp. 4 | No change | 111 276 Total 125 |
| Comp. Exp. A | No change | 91 216 Total 125 |
| Comp. Exp. B | No change | 110 277 Total 167 |

[1]Average of Ten Samples (W means "warp" and F means "Filling")
[2]Average of Three Launderings
[3]Average of Four Measurments (W + F)

All samples in these examples and comparative examples are tested for strength (Grab Break Method - ASTM Method D1682), tear resistance (ASTM Method D1424 Elmendorf Method), abrasion resistance (ASTM Method D3886 Stoll Flex Method and Shrinkage AATCC Method 150-1987). As expected, the control samples have the best physical properties. Durable press treatments reduce the physical properties of garments by at least 50 percent. Except for the light application in Example 3 of the wet-on-wet process, the physical properties have not been significantly reduced below the 50 percent level. The light application results are surprising since the physical properties should be the least affected when compared to the control. There was no change in the wash or shrinkage characteristics of the trousers. This should be predictable since the trousers have already been pre-washed and the durable press treatment tends to set shrinkage.

The most important fabric characteristic is the wrinkle recovery angle (warp plus filling, W+F). For all practical purposes, they are the same for both the wet-on-wet samples. This demonstrates that the appearance of the two garments from a wrinkling point of view are identical for the two fabric samples. The abrasion results are somewhat distorted in that a hand builder (fabric softener) has been cured on the fabric and gives somewhat anomalous results to the data.

The wet-on-wet durable press treatment process provides essentially the same results as the wet-on-dry treatments. Thus, the wet-on-wet technique is acceptable as an alternative to the wet-on-dry process which is a commercially proven system.

EXAMPLE 5

Example 5 provides an analysis of a recycled resin solution that is suitable for use in the invention.

Eleven bath samples from a production run are examined. The bath samples are tested for the following characteristics: 1) percent of 105° C. solids; 2) percent of moisture as calculated by the "Karl Fischer" test; and 3) pH. The results obtained from the analysis of this example are presented in Table 8 as follows:

TABLE 8

| Sample | % 105° C. Solids | % Moisture Karl Fischer | pH |
|---|---|---|---|
| 1 | 4.04 | 96.86 | 3.58 |
| 2 | 3.96 | 97.36 | 3.69 |
| 3 | 3.90 | 96.93 | 3.78 |
| 4 | 3.86 | 97.52 | 3.83 |
| 5 | 3.85 | 97.25 | 3.90 |
| 6 | 3.82 | 96.93 | 4.48 |
| 7 | 3.80 | 97.87 | 4.12 |
| 8 | 3.80 | 97.58 | 4.00 |
| 9 | 3.79 | 97.83 | 4.10 |
| 10 | 3.79 | 97.92 | 4.27 |
| 11 | 3.78 | 97.36 | 4.32 |

Example 5 demonstrates that no scientifically significant adverse changes occur in the treatment solution as a result of the recycling procedure.

What is claimed is:

1. A process for imparting wrinkle resistance and durable press properties to a fibrous garment containing crosslinkable fibers which has undergone a scouring process which comprises the steps of:

soaking said garment in an aqueous solution so that the fibers of the garment swell and a majority of the fibers have an open lumen and then maintaining the garment in a wetted condition, said wetted garment comprising at least about 30 percent by weight of water;

treating said wetted garment with a solution of a crosslinking resin, said resin imparting said wrinkle resistance and durable press properties to said garment while maintaining said open lumen in said fibers, said solution of said resin comprising at least about a 10 percent excess of a stoichiometric amount of said resin required to treat said garment;

removing excess of said solution of said resin; and drying said garment so that the open lumen of the majority of the fibers is maintained in said fibers of the dry garment.

2. The process of claim 1 wherein said solution of said resin comprises at least a 50 percent excess of said stoichiometric amount of said resin required to treat said garment.

3. The process of claim 1 wherein said solution of said resin comprises at least a 100 percent excess of said stoichiometric amount of said resin required to treat said garment.

4. The process of claim 1 wherein said fibers comprise natural fibers.

5. The process of claim 4 wherein said wetting procedure includes soaking said garment for a sufficient time to swell said natural fibers and extracting excess water from said garment.

6. The process of claim 5 wherein said wetting procedure includes soaking said garment in water at ambient temperature.

7. The process of claim 4 wherein said natural fibers comprise cellulosic fibers.

8. The process of claim 7 wherein said cellulosic fibers are cotton fibers.

9. A continuous process for imparting wrinkle resistance and durable press properties to a fibrous garment containing crosslinkable fibers which has undergone a scouring process which comprises the steps of:

(A) soaking said garment in an aqueous solution so that the fibers swell and a majority of the fibers have an open lumen and then maintaining the garment in a wetted condition, said wetted garment comprising at least about 30 percent by weight of water;

(B) treating said garment with a solution comprising a crosslinking resin, said resin imparting said wrinkle resistance and durable press properties to said garment while maintaining an open lumen in said fibers, said solution of said resin comprising at least about a 10 percent excess of a stoichiometric amount of said resin required to treat said garment;

(C) removing excess of said solution of said resin from said garment;

(D) recycling said excess solution of said resin to the treating procedure of step B;

(E) replenishing a concentration of said resin in said recycled solution, said replenished concentration of said resin comprising at least about a 10 percent excess of a stoichiometric amount of said resin required to treat said garment; and (F) drying said treated garment so that the open lumen of the majority of the fibers is maintained in said fibers of the dry treated garment. from said garment;

10. The process of claim 9 wherein said resin is a delayed cure resin.

11. The process of claim 9 wherein said solution of said resin comprises at least a 50 percent excess of said stoichiometric amount of said resin required to treat said garment.

12. The process of claim 11 wherein said solution of said resin comprises at least a 100 percent excess of said stoichiometric amount of said resin required to treat said garment.

13. The process of claim 9 wherein said fibers comprise natural fibers.

14. The process of claim 13 wherein said wetting procedure includes soaking said garment for a sufficient time to swell said natural fibers and extracting excess water from said garment.

15. The process cf claim herein said wetting procedure includes soaking said garment in water at ambient temperature.

16. The process of claim 13 wherein said natural fibers comprise cellulosic fibers.

17. The process of claim 16 wherein said cellulosic fibers comprise cotton fibers.

18. A process for imparting wrinkle resistance and durable press properties to a fibrous garment having natural cellulosic fibers after a scouring process which comprises the steps of:

maintaining said garment in a wetted condition after scouring, said wetted garment comprising at least about 30 percent by weight of water whereby natural fibers in said garment swell and a majority of the natural fibers of the garment have an open lumen;

treating said wetted garment with a solution of a resin while maintaining an open lumen in a majority of said fibers, said resin imparts said wrinkle resistance and durable press properties to said garment, said solution of said resin comprising at least about a 10 percent excess of a stoichiometric amount of said resin required to treat said garment;

removing excess of said solution of said resin; and drying said garment whereby an open lumen is maintained in a majority of the fibers.

19. The process of claim 18 wherein said solution of said resin comprises at least a 50 percent excess of said stoichiometric amount of said resin required to treat said garment.

20. The process of claim 19 wherein said solution of said resin comprises at least a 100 percent excess of said stoichiometric amount of said resin required to treat said garment.

21. The process of claim 19 wherein said wetting procedure includes soaking said garment for a sufficient time to swell said natural fibers and extracting excess water from said garment.

22. The process of claim 19 wherein said wetting procedure includes soaking said garment in water at ambient temperature.

23. The process of claim 19 wherein said natural fibers comprise cellulosic fibers.

24. The process of claim 23 wherein said cellulosic fiber comprise cotton fibers.

25. A garment having wrinkle resistance and durable press properties prepared by the process of claim 1.

* * * * *